US005592043A

United States Patent [19]

Gärtner et al.

[11] Patent Number: 5,592,043

[45] Date of Patent: Jan. 7, 1997

[54] CATHODE INCLUDING A SOLID BODY

[75] Inventors: Georg Gärtner, Aachen; Hans Lydtin, Stolberg, both of Germany

[73] Assignee: U.S. Philips Corporation, New York, N.Y.

[21] Appl. No.: 625,689

[22] Filed: Apr. 3, 1996

Related U.S. Application Data

[63] Continuation of Ser. No. 375,203, Jan. 18, 1995, abandoned, which is a continuation of Ser. No. 25,691, Mar. 3, 1993, abandoned.

[30] Foreign Application Priority Data

Mar. 7, 1992 [DE] Germany ..... 42 07 220.4

[51] Int. Cl.[6] ..... H01J 1/14

[52] U.S. Cl. ..... 313/346 DC; 313/346 R; 252/518

[58] Field of Search ..... 252/515, 518, 252/513, 516, 519, 520; 313/346 R, 346 DC

[56] References Cited

U.S. PATENT DOCUMENTS

| | | | |
|---|---|---|---|
| 3,778,389 | 12/1970 | Kasanami et al. | 252/520 |
| 4,007,393 | 2/1977 | van Stratum et al. | 313/346 R |
| 4,273,683 | 6/1981 | Kawamura | 252/513 |
| 4,298,505 | 11/1981 | Dorfield et al. | 252/513 |
| 4,313,854 | 2/1982 | Sunahara et al. | 252/516 |
| 4,391,846 | 7/1983 | Raymond | 427/99 |
| 4,397,774 | 8/1983 | Boonstra et al. | 252/518 |
| 4,518,890 | 5/1985 | Taguchi et al. | 313/346 R |
| 4,548,742 | 10/1985 | Hormaoaly | 252/519 |
| 4,675,570 | 6/1987 | Green | 313/346 R |
| 4,729,784 | 7/1981 | Misumi et al. | 252/513 |
| 4,900,285 | 2/1990 | Van Esdonk et al. | 445/50 |
| 5,007,874 | 4/1991 | Branovich et al. | 445/50 |
| 5,092,805 | 3/1992 | Shon | 445/50 |
| 5,115,164 | 5/1992 | Joeng et al. | 313/346 DC |
| 5,122,707 | 6/1992 | Nakanishi et al. | 313/346 R |
| 5,126,623 | 6/1992 | Choi | 313/346 DC |
| 5,128,584 | 7/1992 | Choi | 313/346 DC |
| 5,173,633 | 12/1992 | Joo et al. | 313/270 |
| 5,314,364 | 5/1994 | Snijkers et al. | 445/51 |

FOREIGN PATENT DOCUMENTS

| | | | |
|---|---|---|---|
| 202582 | 7/1956 | Australia | 313/346 DC |
| 0333369 | 9/1989 | European Pat. Off. | H01J 1/14 |
| 0395157 | 10/1990 | European Pat. Off. | H01J 1/14 |
| 0442163 | 8/1991 | European Pat. Off. | C23C 14/28 |

OTHER PUBLICATIONS

"Advance in Physics", 24, NR. 3, MEI 1975, pp. 407–461.

*Primary Examiner*—Alvin E. Oberley
*Assistant Examiner*—Lawrence O. Richardson
*Attorney, Agent, or Firm*—Norman N. Spain

[57] ABSTRACT

Cathode including a solid body (4) which comprises metallic constituents (particularly W, Ni, Mg, Re, Mo, Pt) and oxidic constituents (such as particularly BaO, CaO, $Al_2O_3$, $Sc_2O_3$, SrO, $ThO_2$, $La_2O_3$).

Also at low operating temperatures, high emission current densities and a long lifetime are achieved in that the structure of the constituents and the volume ratio $v_m$ of the metallic constituents relative to the overall volume of the solid body are chosen to be such that the resistivity ρ has a value in the range of $\rho_0 \cdot 10^{-4} > \rho > \rho_m \cdot 10^2$, in which $\rho_0$ and $\rho_m$ are the resistivities, defined at 20° C., of the pure oxidic constituents and the pure metallic constituents, respectively.

23 Claims, 2 Drawing Sheets

CATHODE INCLUDING A SOLID BODY

This is a continuation of application Ser. No. 08/375,203, filed Jan. 18, 1995, now abandoned, which is a continuation of Ser. No. 08/025,691 filed Mar. 3, 1993, now abandoned.

BACKGROUND OF THE INVENTION

The invention relates to a cathode including a solid body which comprises metallic constituents (particularly W, Ni, Re, Mo, Pt) and oxidic constituents (such as particularly BaO, CaO, $Al_2O_3$, $Sc_2O_3$, SrO, $ThO_2$, $La_2O_3$).

Dispenser cathodes include a solid body in the form of a porous metal matrix having more than 70% of metal volume content so that a satisfactory electric conductivity is obtained, as well as an oxide component such as, for example alkaline earth oxide BaO or CaO or $4BaO.CaO.Al_2O_3$ which is present in the pores of the metal matrix or in a dispenser area. When operating such a cathode at 900° to 1000° C., atomic films are produced which consist of the metal(s) (Ba) present in the oxide and atomic oxygen (O) on the metal cathode surface (W) and ensure a low work function. Known cathodes of this type are the I cathode (cf. EP-A 0 333 369) and the scandate cathode (cf. EP-A 0 442 163). Such cathodes have the characteristic features described in the opening paragraph.

At operating temperatures between 900° C. and 1000° C. saturation current densities of between 10 and 150 A/cm$^2$ are achieved. Such cathodes require relatively high heating temperatures which limit the lifetime due to destruction of the W heating coil.

Oxide cathodes (cf. EP-A 0 395 157) have a relatively thick porous oxide layer of alkaline earth oxides (for example, Bao.SrO) and further oxide dopants (for example, $Sc_2O_3$, $Eu_2O_3$) on a metal support such as nickel. They can be used at substantially lower operating temperatures of approximately 730° to 850° C. with emission current densities of 10 to 50 A/cm$^2$, but only in the μsec range. Because of the low electric conductivity of the oxide components, the permanent load capacity is limited to 1–3 A/cm$^2$.

OBJECTS AND SUMMARY OF THE INVENTION

It is an object of the invention to provide a solid body of the type described in the opening paragraph with which high emission current densities and a long lifetime can be obtained, also at low operating temperatures.

This object is solved in that the structure of the constituents and the volume ratio $v_m$ of the metallic constituents relative to the overall volume of the solid body are chosen to be such that the resistivity ρ has a value in the range of $\rho_0 \cdot 10^{-4} > \rho > \rho_m \cdot 10^2$, in which $\rho_0$ and $\rho_m$ are the resistivities, defined at 20° C., of the pure oxidic constituents and the pure metallic constituents, respectively.

The term "percolation" is used in relation with the behaviour of granular metals in "Adv. Physics" 24 (1975), pp. 424 etc.

The resistivity ρ of a solid body according to the invention has a value in the range of a threshold known as the percolation threshold. Cathodes including solid bodies according to the invention may therefore be referred to as percolation cathodes.

The metallic conductivity changes to the oxidic conductivity in the range of the percolation threshold of a material composed of metallic and oxidic fine particles. Dependent on the volume-percent content of the metal ($v_m$) of the solid body, the resistivity ρ between $v_m$=0 and $v_m$=1 changes with a typically S-shaped variation, while the percolation threshold range is defined by the steep characteristic curve at average values of $v_m$. This range may also be mathematically defined by the relations $d^2\log\rho/dV_m^2 \sim 0$ and $d^3\log\rho/dV_m^3 < 0$. The resistivity ρ in this range is between $\rho_0 10^{-4}$ and $\rho_m 10^2$, preferably between $10^3$ Ωcm and $10^{-3}$ Ωcm. The range envisaged in accordance with the invention will be further explained with reference to FIG. 2. This Figure shows on a logarithmic scale the resistivity ρ (measured at room temperature) of a solid body composed of BaO and W particles having an average size of 30 nm in dependence upon the volume-percent metal content $v_m$. In the range of $v_m$=0 the high resistivity $\rho_0$ of a BaO solid body is obtained and in the range $v_m$=100% the resistivity $\rho_m$ of tungsten is obtained. An oxidic conductance is found in the range $0<v_m<v_a$ and a metallic conductance is found in the range $v_{mb}<v_m$ 100%. A mixed conductance is obtained in the range $v_{ma}<v_m<v_{mb}$ of the percolation threshold. The relative volume composition of a solid body according to the invention is chosen in the range of the steep characteristic curve P between the limit values $v_{ma}$ and $v_{mb}$, with volume contents in the shaded area being very favourable for cathodes. For this shaded area the additional condition applies that $d^4\log\rho/dV_m^4$ is positive. The limit values $v_{ma}$ and $v_{mb}$ may include the range between $v_m$=20% and $v_m$=80%. The slope of the characteristic curve P is largely dependent on the structure of the solid body according to the invention, viz. on the size of the metallic and/or oxidic particles as well as on the homogeneity of their distribution. An advantageous embodiment is characterized in that the metallic volume content is smaller than the oxidic volume content and is preferably between 33% and 50%.

Particles in the sense of the present invention are in particular particles which are formed separately (laser ablation, sputtering of a target) and are compounded to a solid body, or grains formed on a substrate by chemical deposition from the vapour phase (CVD). Separately formed further particles may be admixed with the CVD grains (cf. EP-A 0 442 163) so that, for example BaO particles supplied to the substrate via a gas stream are embedded in a tungsten matrix formed by CVD on the substrate.

Solid bodies according to the invention comprise fine and homogeneously mixed structures of individual, chemically different solid state elements, in which a spatial network of metallic constituents, each metal constituent consisting of at least one metal and each metallic constituent contacting at least one other metallic constituent, is interleaved in a spatial network of oxidic constituent, each oxidic constituent consisting of at least one oxide and each oxidic constituent contacting at least one other oxidic constituent, or conversely, while tunnel parths may be included. Both the oxidic and the metallic constituents may be particles or grains.

Very high emission current densities are achieved in that the metallic constituents or the oxidic constituents are homogeneously distributed in the form of particles in the other constituent in such a way that the number of particles in volume ranges of $(20\bar{d})^3$ differs by less than ±20% from the corresponding volume content in the overall solid body, in which $\bar{d}$ is the average diameter of the particles. Large, local agglomerations of particles should be avoided.

The solid body according to the invention is preferably characterized in that the metallic particles are arranged in such a way that—possibly via tunnel current paths—the oxidic network comprises ducts having a metallic conductivity.

Heavy-duty cathodes are also obtained in that the average diameter $\bar{d}$ of the particles is smaller than 800 nm, preferably between 0.5 nm and 100 nm and particularly between 1 nm and 20 nm.

In the case of small particle dimensions solid bodies having the desired percolation properties can be manufactured in a very reliable way. The solid body properties (for example, electric resistance) are adequately isotropic when the particles are mixed intimately.

With a dimensioning outside the shaded area shown in FIG. 2 it is advantageous that the resistivity ρ is set between $10^2$ and $10^{12}$ Ωcm and that the average diameter $\bar{d}$ of the particles is between 0.5 nm and 4 nm.

The desired value can be advantageously achieved, while maintaining the economy of the manufacturing process in that the diameters $\bar{d}$ of the particles have a monomodal distribution and a half-value width of ≦50% at the average value of $\bar{d}$.

In accordance with a preferred embodiment, both the metallic and the oxidic constituents are present in the form of particles, in which the average diameter $\bar{d}_1$ of the particles of one constituent is smaller than approximately 100 nm and the average diameters $\bar{d}_2$ of the bodies of the particles of the other constituent is smaller than 10 times the value $\bar{d}_1$, and in that the particles of the two constituents have such a homogeneous distribution that in a volume range of $(20\ \bar{d}_2)^3$ the numbers of particles of each constituent differ by less than ±20% from the corresponding volume content in the overall solid body.

A granular solid body is obtained which has favourable isotropic solid body properties if the diameters of all particles are between 0.5 nm and 100 nm, while its properties can also be maintained with a small spread in a mass production.

Percolation cathodes composed of solid bodies in accordance with the invention have a higher load capacity than oxide cathodes, and require lower operation temperatures than dispenser cathodes.

The following material combinations are very suitable:

| Oxidic content | Metallic content |
|---|---|
| BaO CaO $Al_2O_3$ $Sc_2O_3$ | W |
| BaO SrO | W, Ni, |
| BaO SrO $Sc_2O_3$ | W Ni |
| $ThO_2$ | W* Re |
| $La_2O_3$ | Mo* Pt |

*an admixture of $W_2C$ and $Mo_2$ with W and Mo, respectively, may be advantageous.

Solid bodies according to the invention only require relatively low operating temperatures between 730° and 850° C. Since a high temperature impregnation at temperatures of more than 1500° C. or a relatively long activation at temperatures of approximately 1100° C. are not necessary, the structure of a solid body made in accordance with the invention remains substantially stable, even when components are used whose mutual solubility is not negligible.

A solid body according to the invention may be heated by direct passage of current. Such a solution is advantageously characterized in that the contents and/or the particle sizes of the oxidic constituents (negative temperature coefficient) and/or metallic constituents (positive temperature coefficient) are chosen to be such that the resistivity changes by less than 5%, preferably by less than 1% between ambient temperature and operating temperature. This has the advantage that, when the solid body is directly heated, it is not necessary or hardly necessary to readjust the heating current and voltage upon heating to a given operating temperature.

Solid bodies according to the invention can be manufactured in any desired known manner. Suitable methods are described, for example in EP-A 0 442 163 or in EP-A 0 333 369.

The advantageous properties of a solid body according to the invention are not only achieved in the case of a compact and 100% solid structure. A porosity of up to approximately 20% is even advantageous, because this facilitates the dispensing process of the emissive film components to the surface. Nevertheless, the electric conductivity is not essentially determined by electron gas conductance, but substantially only by the percolation structure.

BRIEF DESCRIPTION OF THE DRAWINGS

These and other aspects of the invention will be apparent from and elucidated with reference to the embodiments described hereinafter.

In the drawing

DESCRIPTION OF THE PREFERRED EMBODIMENTS

Figure 1:
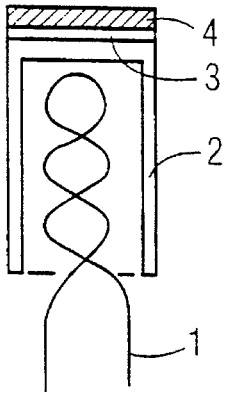
FIG. 1 shows the structure of a cathode including a solid body according to the invention.
Figure 2:
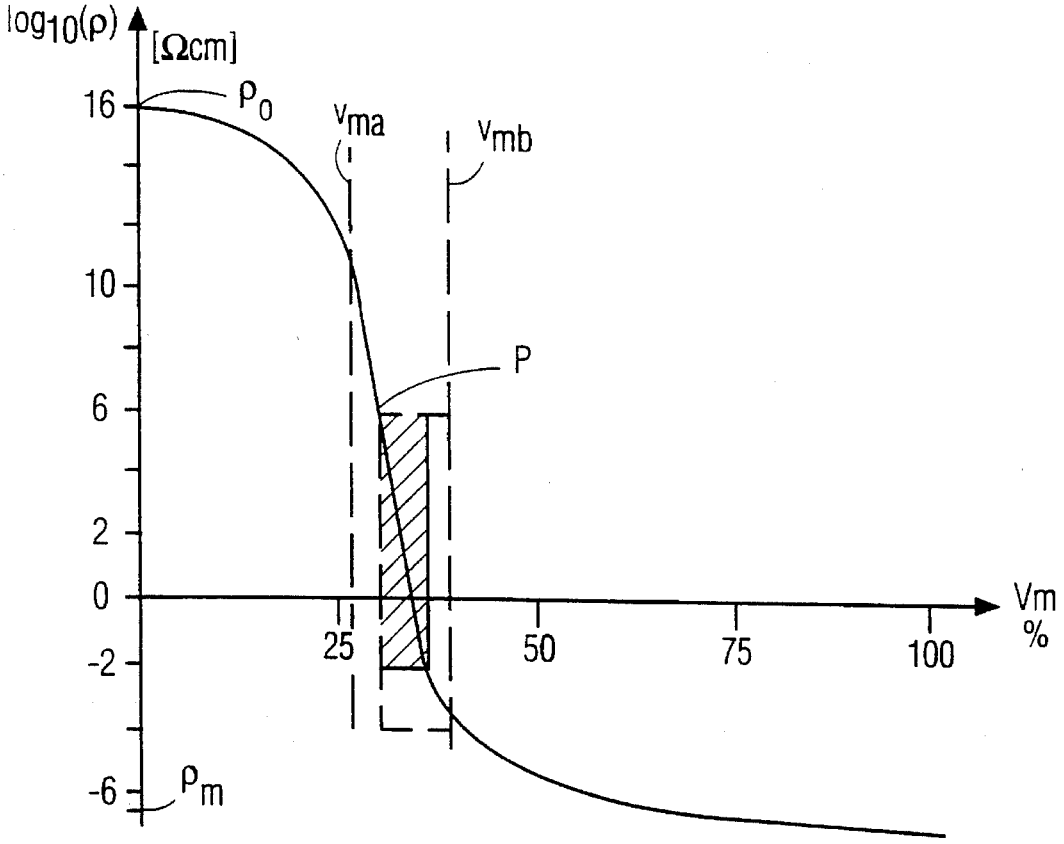
FIG. 2 shows the resistivity ρ in dependence upon the volume-percent content $v_m$ of metallic constituents of a nano-structured solid body comprising metallic and oxidic constituents.

The percolation cathode shown in a cross-section in FIG. 1 comprises a tungsten heating coil 1, a molybdenum heating cap 2, a metal base 3 of tungsten or nickel and a solid body 4 structured in accordance with the invention and having a resistivity ρ in the range of the percolafion threshold on the characteristic curve P in FIG. 2.

Figure 3:
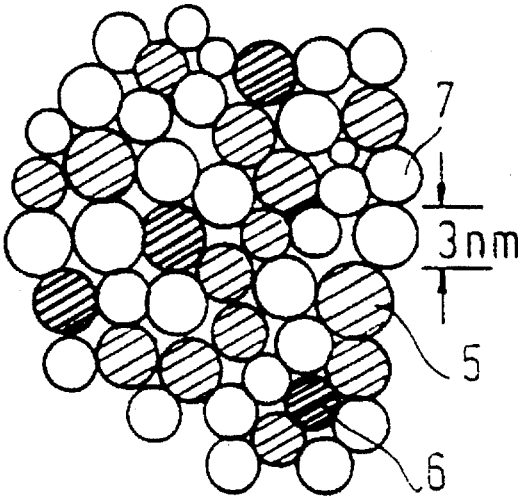
FIG. 3 shows the structure of a volume element of the solid body of FIG. 1.

A volume element of the solid body 4 is shown in a cross-section on a much larger scale in FIG. 3. The Figure shows a relatively compact structure of interconnected particles with a low pore content of approximately 10% by volume. The metallic particles 5 (shaded) comprise tungsten (28% by volume). The oxidic particles 6 (densely shaded) comprise scandium oxide $Sc_2O_3$ (2% by volume), while the oxidic particles 7 (not shaded) comprise barium oxide/strontium oxide (BaO/SrO) with an overall volume content of 60% by volume. The average diameter of the particles 5, 6 and 7 is $\bar{d}$=3 nm.

At an operating temperature of 730° C., an ambient pressure of $10^{-8}$ Torr, a pulse emission (5 μsec) of 25 A/cm$^2$ was achieved. As a permanent load, a value of 10 A/cm$^2$ was possible in the space-charge limited range, i.e. in spite of a low operating temperature, values were obtained which were 4 times higher than in oxide cathodes.

Figure 4:
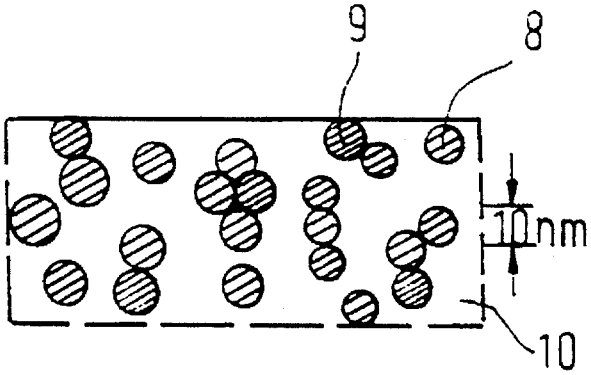
FIG. 4 shows an alternative structure of a solid body as shown in FIG. 1.

At an operating temperature of 880° C. pulse emission current densities of more than 160 A/cm$^2$ and permanent loads of 20 A/cm$^2$ were measured. The values for the permanent load capacity apply to lifetimes of more than $10^4$ hours. Similarly, satisfactory values were achieved with a modified poreless structure as shown in FIG. 4, which structure had the same contents of constituents W, $Sc_2O_3$ or BaO/SrO as the structure shown in FIG. 3. However, in this structure W and $Sc_2O_3$ are embedded as particles 8 and 9 with an average diameter of 10 nm in a solid body matrix 10 of BaO/SrO.

We claim:

1. A cathode comprising a solid body which solid body comprises metallic constituents selected from the group consisting of W, Ni, Re, and Pt and oxidic constituents selected from the group consisting of BaO, CaO, $Al_2O_3$, $Sc_2O_3$, SrO, $ThO_2$ and $La_2O_3$, characterized in that the structure of said metallic and oxidic constituents and the volume percent Vm of the metallic constituents relative to the overall volume of the solid body are chosen to be such that the resistivity of the solid body ρ has a value of $\rho_0 \cdot 10^{-4} > \rho > \rho_m \cdot 10^{-2}$, wherein $\rho_0$ and $\rho_m$ are the resistivities, defined at 20° C., of the pure oxidic constituents and the pure metallic constituents, respectively, each of said constituents being a particle or grain.

2. A cathode as claimed in claim 1, characterized in that the resistivity is between $10^3$ Ωcm and $10^{-3}$ Ωcm.

3. A cathode as claimed in claim 1 wherein the volume content of the metallic constituents Vm is between 20% and 80% by volume of the solid body.

4. A cathode as claimed in claim 1, characterized in that means are provided by which a heating current can be passed through the solid body.

5. A cathode as claimed in claim 1 characterized in that the volume content of the metallic constituents Vm is less than that of the oxidic constituents.

6. The cathode of claim 1 characterized in that the metallic constituents are selected from the group consisting of W, Ni, Mg, Re, Mo, and Pt and the oxidic constituents are selected from the groups consisting of BaO, CaO, $Al_2O_3$, $Sr_2O_3$, SrO, $ThO_2$, and $La_2O_3$.

7. A cathode as claimed in claim 2, characterized in that the metallic volume percent $v_m$ is between 20% and 80% by volume.

8. A cathode as defined in claim 2, characterized in that the metallic volume percent is smaller than the volume percent of the oxidic constituents and is preferably between 33% and up to but not including 50%.

9. A cathode as claimed in claim 2, characterized in that the average diameter $\bar{d}$ of particles in said cathode is smaller than 800 nm.

10. A cathode as claimed in claim 2 characterized in that the oxidic constituents are present as a spatial network of oxidic components and the metallic constituents are present as a spatial network of metallic particles interleaved in said spatial network of oxidic components, said spatial network of metallic particles being present in a manner so as to provide ducts having a metallic conductivity in said network of oxidic components.

11. A cathode as defined in claim 3, characterized in that the metallic volume percent is smaller than the volume percent of the oxidic constituents and is preferably between 33% and up to but not including 50%.

12. A cathode as claimed in claim 3, characterized in that the average diameter $\bar{d}$ of particles in said cathode is smaller than 800 nm.

13. A cathode as claimed in claim 5, characterized in that the average diameter $\bar{d}$ of particles in said cathode is smaller than 800 nm.

14. A cathode as claimed in claim 3 characterized in that the oxidic constituents are present as a spatial network of oxidic components and the metallic constituents are present as a spatial network of metallic particles interleaved in said spatial network of oxidic components, said spatial network of metallic particles being present in a manner so as to provide ducts having a metallic conductivity in said network of oxidic components.

15. A cathode as claimed in claim 4, characterized in that the contents and/or the particle sizes of the oxidic and/or metallic constituents are chosen to be such that the resistivity ρ changes by less than 5%, between ambient temperature and operating temperature.

16. A cathode as claimed in claim 4, characterized in that the constituents and/or the particle sizes of the oxide and/or metallic constituents are chosen to be such that the resistivity ρ changes by less than 1% between ambient temperature and operating temperature.

17. A cathode as claimed in claim 5 characterized in that the volume content of the metallic constituents Vm is between 33% and up to but not including 50% by volume of the solid body.

18. A cathode as claimed in claim 5 characterized in that the oxidic constituents are present as a spatial network of oxidic components and the metallic constituents are present as a spatial network of metallic particles interleaved in said spatial network of oxidic components, said spatial network of metallic particles being present in a manner so as to provide ducts having a metallic conductivity in said network of oxidic components.

19. A cathode as claimed in claim 6, characterized in that the average diameter $\bar{d}$ of particles in said cathode is smaller than 800 nm.

20. A cathode as claimed in claim 1, characterized in that the average diameter $\bar{d}$ of the particles is smaller than 800 nm.

21. A cathode as claimed in claim 1, characterized in that each metallic constituent comprises at least one metal selected from the group consisting of W, Ni, Mg, Re, Mo, and Pt.

22. A cathode as claimed in claim 1, characterized in that each oxidic constituent comprises at least an oxide selected from the group consisting of BaO, CaO, $Al_2O_3$, ScO, $ThO_2$ and $La_2O_3$.

23. A cathode as claimed in claim 1 characterized in that the oxidic constituents are present as a spatial network of oxidic components and the metallic constituents are present as a spatial network of metallic particles interleaved in said spatial network of oxidic components, said spatial network of metallic particles being present in a manner so as to provide ducts having a metallic conductivity in said network of oxidic components.

* * * * *